US006959770B2

(12) United States Patent
Clelland

(10) Patent No.: US 6,959,770 B2
(45) Date of Patent: Nov. 1, 2005

(54) PORTABLE DRILLING APPARATUS

(75) Inventor: Patrick J. Clelland, Rochester, NY (US)

(73) Assignee: Dynadrill, Inc., Rochester, NY (US)

( * ) Notice: Subject to any disclaimer, the term of this patent is extended or adjusted under 35 U.S.C. 154(b) by 0 days.

(21) Appl. No.: 10/676,489

(22) Filed: Oct. 1, 2003

(65) Prior Publication Data

US 2005/0072587 A1 Apr. 7, 2005

(51) Int. Cl.[7] ..... E21C 5/00; E21B 19/00
(52) U.S. Cl. ..... 173/4; 173/152; 175/57
(58) Field of Search ..... 173/4, 11, 17, 173/19, 152; 175/57, 171

(56) References Cited

U.S. PATENT DOCUMENTS

| | | | | |
|---|---|---|---|---|
| 199,640 A | | 1/1878 | Haas et al. | |
| 2,061,908 A | | 11/1936 | Huffman | |
| 2,588,068 A | | 3/1952 | Williams et al. | |
| 2,848,196 A | | 8/1958 | Simmonds | |
| 2,904,310 A | | 9/1959 | Leonard | |
| 3,169,590 A | | 2/1965 | Thatcher | |
| 3,174,562 A | | 3/1965 | Stow | |
| 3,232,360 A | | 2/1966 | Dickinson | |
| 3,451,491 A | | 6/1969 | Clelland | |
| 3,550,701 A | | 12/1970 | Holley | |
| 3,881,558 A | * | 5/1975 | Dolza | 173/152 |
| 4,179,001 A | * | 12/1979 | Still et al. | 175/57 |
| 4,248,312 A | * | 2/1981 | Jinno et al. | 175/57 |
| 4,421,175 A | * | 12/1983 | Boyadjieff et al. | 166/383 |
| 4,553,612 A | | 11/1985 | Durham | |
| 4,558,748 A | * | 12/1985 | Gergo et al. | 175/57 |
| 6,343,662 B2 | * | 2/2002 | Byrt et al. | 173/4 |

* cited by examiner

*Primary Examiner*—Scott A. Smith
(74) *Attorney, Agent, or Firm*—Stephen B. Salai, Esq.; Roger Aceto, Esq.; Harter, Secrest & Emery, LLP

(57) ABSTRACT

A drilling apparatus for drilling underground, small diameter bore holes wherein a support frame of the apparatus is formed in part by a pair of hydraulic cylinders arranged parallel one to another. A head mounting plate that carries the drill motor is releaseably attached to a barrel portion of each hydraulic cylinder and the barrel portion is urged by fluid pressure along a support rod extending axially through the barrel. The ends of the support rods are attached by front and rear supports to form a frame that is anchored in position relative to the movable barrel.

21 Claims, 3 Drawing Sheets

PORTABLE DRILLING APPARATUS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

1. Field of the Invention

The present invention relates generally to drilling machinery and more particularly to a portable drilling machine for drilling horizontal boreholes under a street or building or the like to facilitate the installation of underground tubing or cables as may be used to conduct a utility.

2. Background Art

Relatively small diameter horizontal boreholes are often drilled beneath a street or building. Such holes are drilled to accommodate passage of a utility line such as a water, gas or electric line from a main supply trunk running along a street to the basement of a residence or business establishment.

The drilling of a borehole often is accomplished by first laying a frame or track in the basement of a building and then anchoring the frame in position. The frame is laid generally perpendicular to a basement wall so a borehole can be bored through the wall and underground to the utility trunk running along the street. A movable carriage, which carries a drill motor, is mounted to the frame and is movable along the frame or track for advancing a drill bit into the working face of the basement wall. A hydraulic cylinder or the like arranged between the frame and the carriage provides the thrust for moving the carriage relative to the anchored frame to advance the drill motor and bit into the working face.

The drilling apparatus for drilling the boreholes as described should be portable and relatively lightweight. As noted above the apparatus often is used in close quarters such as a basement. Various obstacles such as, for example, a furnace, water heater, piping, laundry tubs and wall panels or room dividers may further restrict the close quarters. Also, access to the work area may be further restricted by a narrow entry, hallway, stairway or the like.

Accordingly, the apparatus preferably should be composed of components that are easily transported and assembled on site. That is the apparatus should be sufficiently portable to be hand carried into the work area by one or two persons. Individual components must be short, narrow and lightweight so the apparatus is easy to set up and, after the job is done, easy to disassemble and carry away.

It also is important to control and maintain the angle of attack of the drill bit relative to the working face. Setting and maintaining the correct attitude throughout the drilling operation insures that the borehole extends in the direction to intersect the trunk line, which may be at some distance from the building and at a different elevation than the drilling site. While existing apparatus provide one or more of the desired features of such drilling apparatus, the portability of the apparatus, simplification of components, ease of assembly and disassembly and direction control are all features that are improved by the present invention.

Accordingly, it is an object of the present invention to provide an improved drilling apparatus of the type used for drilling small diameter boreholes, the apparatus including components that are portable and are easily assembled and disassembled.

Another object of the present invention is to provide drilling apparatus for drilling horizontal boreholes that has improved direction control of the drill bit.

Yet another object is to provide drilling apparatus of the type described that reduces the number of components needed to assemble the apparatus.

A further object of the invention is to provide a drilling apparatus of the type described which eliminates the need to assemble the frame and movable carriage mounted to the frame from separate members.

BRIEF SUMMARY OF THE INVENTION

The drilling apparatus of the present invention includes separable components that can be assembled and disassembled with a minimum of effort. The apparatus has fewer components than comparable apparatus of the prior art and this further facilitates setting up the apparatus. Eliminating the need for components dedicated solely to forming a rigid frame reduces the number of components and facilitates the assembly and disassembly of the apparatus. The present invention further integrates the movable carriage that (to which is mounted the drill motor) and the means for advancing the carriage into a single structure.

In the present invention the support frame that is anchored at the work site is assembled, in part, using a pair of hydraulic thrust cylinders and the carriage for moving the drill motor is provided by a component of the thrust cylinders. Thus the same hydraulic thrust cylinders that provide the means for advancing a drill bit into the working face also comprise components of both a fixed support frame and a carriage that is movable along the frame. This significantly reduces the number and weight of components in that it eliminates the need for support frame components that are separate and apart from the movable carriage that carries the drill motor.

Accordingly, a portable drilling apparatus of the present invention for use in drilling underground holes includes a pair of hydraulic cylinders. Each cylinder includes a barrel with a support rod extending axially through the barrel. The support rods are designed to be anchored in position and form parts of the frame of the apparatus. The barrel of the cylinder has fluid ports adjacent its ends wherein the introduction of fluid under pressure through one or another of the ports moves the barrel respectively forward and aft along the fixed support rod. In this fashion the cylinder barrels comprise the movable carriage of the apparatus.

Forward and aft support assemblies that connect the opposite ends of the support rods one to another complete the frame of the apparatus. The support assemblies hold the rods spaced apart and generally parallel. A head mounting plate including a drill motor is releasably mounted to each of the barrels and spans the space between the two barrels. This allows the drill motor to move with the barrels of the hydraulic cylinders.

In operation, the forward and aft support assemblies are attached to the ends of the support rods to form a frame. The support assemblies then are anchored in position to fix the position of the frame. Now, when fluid is introduced into one end of the barrel of the hydraulic cylinders, the barrels advance along the support rods and the advance of the barrels in turn advances the head mounting plate and drill motor (and a drill bit attached to the motor) towards the working face to drill the borehole.

Accordingly, the present invention may be characterized in one aspect thereof by a portable drilling apparatus comprising:

a) a pair of hydraulic cylinders disposed and arranged generally parallel one to another, each cylinder having a barrel portion disposed on a support rod, the barrel being movable along the support rod in responses to the introduction of fluid under pressure into one end or another of the barrel;

b) a head mounting plate assembly supported by the pair of hydraulic cylinders; and c) a drill motor supported by the head mounting plate assembly, the drill motor driving a drill bit extending forward of the pair of hydraulic cylinders.

DETAILED DESCRIPTION OF THE INVENTION

Figure 1:
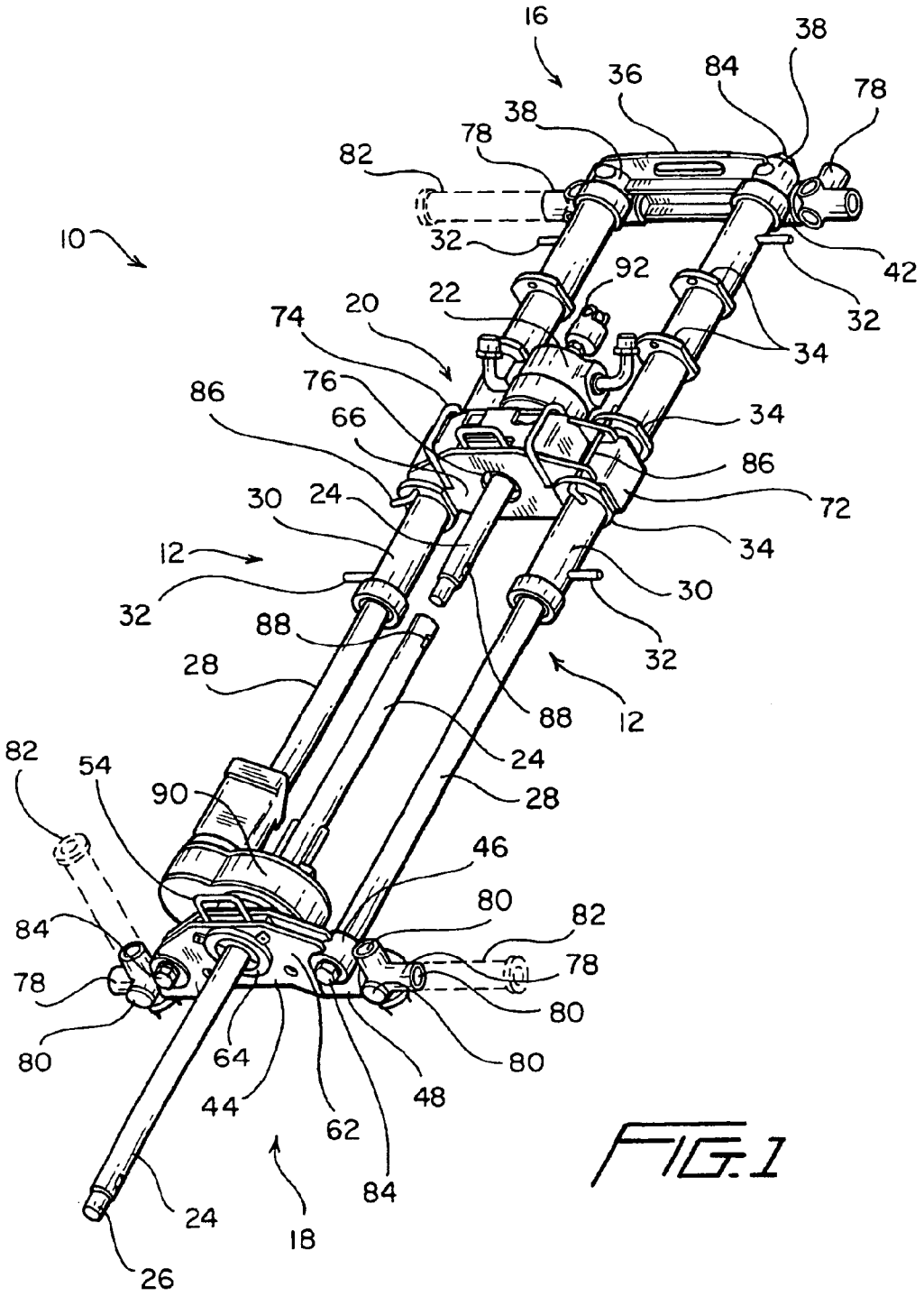
FIG. 1 is a perspective view showing an assembled portable drilling apparatus of the present invention.

Referring to the drawings, FIG. 1 shows the drilling apparatus of the present invention generally indicated at 10. The drilling apparatus includes a pair of hydraulic thrust cylinders 12, a rear support assembly 16, a front support assembly 18 and a head mounting plate assembly 20. Each of these components is separable one from the other to facilitate the portability of the drilling apparatus.

Attached to the mounting head is a drill motor 22. The drill motor preferably is a hydraulic motor utilizing oil under pressure as the motive force. The drill motor is adapted to drive one or more drill pipes 24 that extend forward of the front support 18 and connect to a drill bit 26.

The hydraulic thrust cylinders 12 each comprise a rod 28 and a barrel 30. Rather than having the rod extend from one end of the barrel, the rod of the thrust cylinder 12 is a support rod that extends axially through the barrel. The barrel has fluid inlets 32 adjacent the opposite ends of the barrel. Wit this arrangement, when the support rod 28 is held fixed (as further described hereinbelow) the introduction of fluid under pressure into one of the fluid inlets will move the barrel 30 in a forward direction along the rod. Conversely the introduction of fluid into the other inlet will move the barrel in an aft direction along the rod. Hydraulic thrust cylinders of the type described are conventional and known in the art.

The barrels 30 are modified by the attachment of at least one pair and preferably two pairs of flanges 34. When the ends of the support rod are fixed, these flanges provide the means for transmitting the force produced by the cylinder to the drill motor 22 as described hereinbelow.

Figure 2:
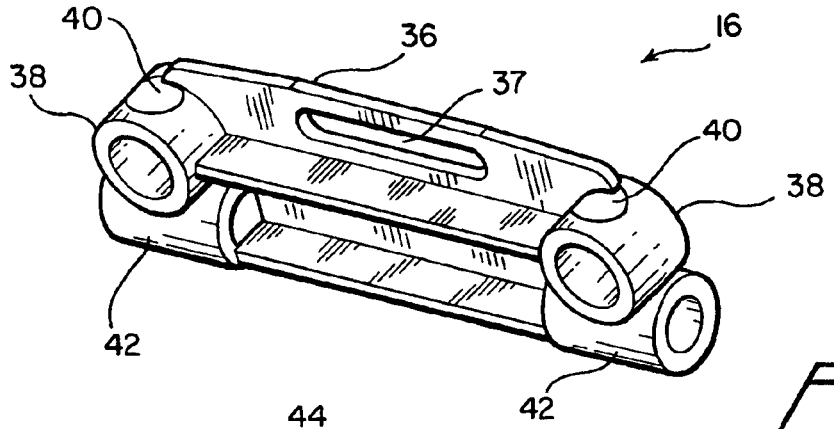
FIG. 2 is a perspective view on a larger scale of a rear support member of the drill apparatus.

Turning to FIG. 2, the rear support assembly 16 includes a rear support plate 36 having an elongated opening 37 that provides a handgrip for carrying the rear support assembly. Attached to each end of the support plate is a forward facing rear stop 38. The stops are in effect circular receptacles to receive the aft ends of the support rods. Each stop includes a welded insert 40. The inserts have a flat inner surface (not shown) that matches a corresponding flat on the aft end of the support rod. The disposition of the flats on both the inserts and rods allow a proper orientation of the support rods when the ends of the rods are inserted into the rear stops. The stops also allow for proper assembly torque by holding the end of the support rod as bolts or screws 84 are turned to connect the rear support to the support rod as shown in FIG. 1. The flats further prevent the rods from turning in the stops as the barrels are moved along the support rods.

Also attached to each end of the rear support plate 36 and below the stop 38 is a rear anchor tube 42. As shown in FIG. 2, the rear anchor tubes extend outward from under the stops and the axis of the tube is generally normal to the axis of the stop.

Figure 3:
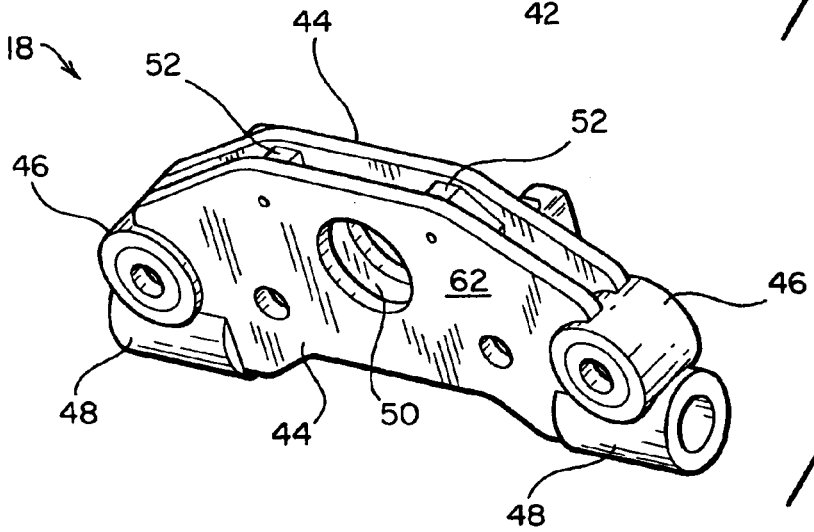
FIG. 3 is a perspective view on a larger scale of a front support of the drill apparatus with certain components removed for clarity.

FIG. 3 shows that the front support assembly 18 is similar in construction to the rear support 16. In this case however, two parallel and spaced apart front plates 44 form the support plate. The ends of the plates are attached to aft facing front stops 46. The stops are circular and are adapted to receive the front ends of support rods 28. Also attached to each end of the plates 44 and below the stop 46 is a front anchor tube 48. As shown in FIG. 3, each anchor tube 48 extends outward from under a stop 46 and the axis of each tube is generally normal to the axis of the stops. An opening 50 through both plates 44 allows for the passage of the drill pipe 24 through the front support assembly (FIG. 1).

Figure 5:
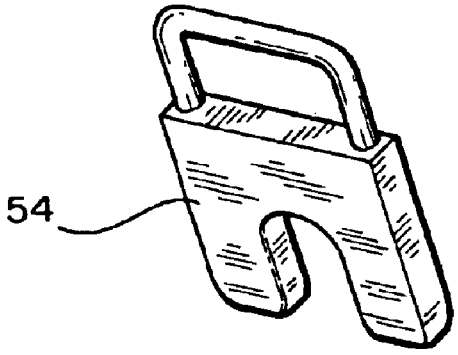
FIG. 5 is a perspective view on a larger scale of a removable vise component of the front support.

Disposed between the two plates 44 and to either side of the opening 50 are wrench stops 52. The wrench stops act as guides for a front vise 54 (FIG. 5) that may be inserted between the two plates 44. The vise primarily is used to facilitate the separation of the drill pipes as further described hereinbelow. Also, latches (not shown) may be provided that can be used to hold the vise in place between the two plates 44. In this case the vise can be used as a carrying handle for the front support assembly 18.

Figure 6:
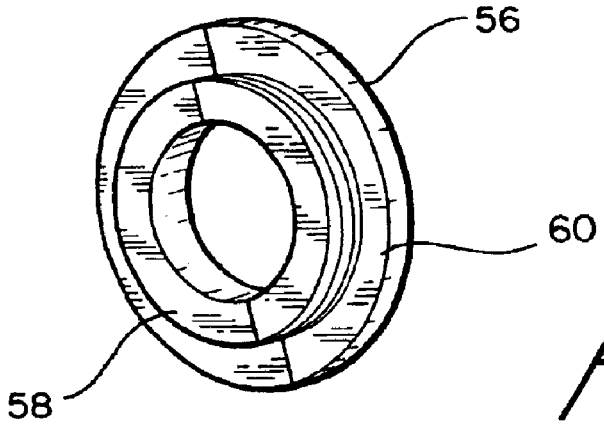
FIG. 6 is a perspective view on a larger scale and from a reverse angle of a removable bushing component of the front support.

Not shown in FIG. 3 is a centering device or "centralizer" that completes the front support assembly. As best seen in FIG. 6 the centralizer 56 is a bushing formed by a split ring having a central hub portion 58 and a surrounding flange 60. The hub is sized to fit into the opening 50 and around a drill pipe 24. The hub reduces clearance between the periphery of the opening 50 and the drill pipe to prevent eccentric motion of the drill pipe at the start of the drilling operation. As shown in FIG. 1, the centralizer is releasably held to the front face 62 of plate 44 by a bracket 64 (FIG. 1) that is attached by screws or the like to the front face.

Figure 4:
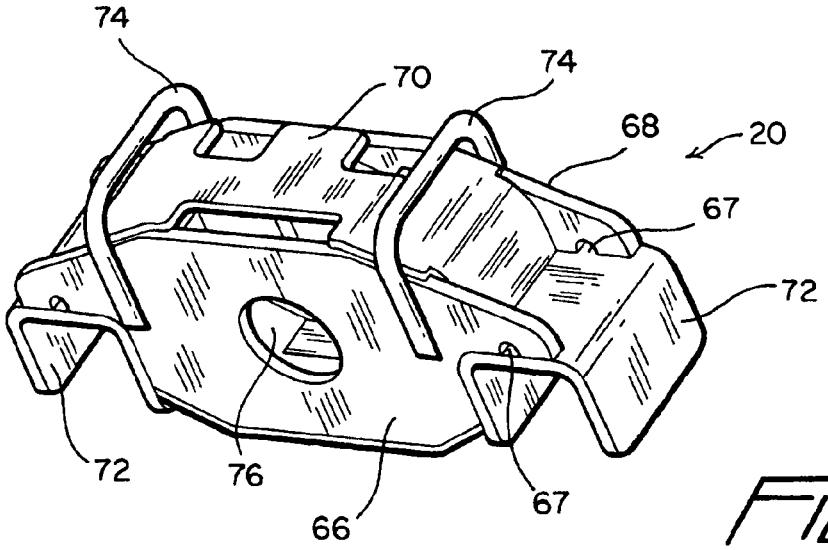
FIG. 4 is a perspective view on a larger scale of the head mounting plate of the drill apparatus.

FIG. 4 shows the mounting plate assembly 20 as being formed by front and rear head brackets 66, 68. The brackets are spaced one from another by an upper spacer 70 and a similar bottom spacer (not shown). Yokes 72 are attached to outboard portions of the front and rear head brackets. These yokes are generally U-shaped and are of a size sufficient to fit over and straddle the barrels 30 between the welded on flanges 34 (FIG. 1). Also attached to the head brackets is a pair of handles 74 to facilitate transportation of the mounting plate assembly. Both front and rear head brackets have aligned openings 67 adjacent the yokes 72. As shown in FIG. 1, these openings are aligned with corresponding openings in the flanges 34 so that a lock pin 86 inserted through the openings will serve to attach the mounting plate assembly to the barrels 30. As also shown in FIG. 1, the drill motor 22 is attached to the rear head bracket 68 and the operating spindle of the motor extends through an opening 76 in the head brackets.

Referring again to FIG. 1, the drilling apparatus is shown to further include an anchoring and leveling system comprising four connectors 78 that are releasably attached to each of the rear and front anchor tubes 42, 48 respectively. Each connector has ports 80 oriented along an "X", "Y" and "Z" axis. Each port can receive a hydraulic jack (only two of which are shown schematically in dotted line at 82) as needed to orient and anchor the drilling apparatus.

Operation of the drilling apparatus will be described as beginning with the components of the apparatus in a disconnected condition. In this condition the individual components, namely the two hydraulic thrust cylinders 12, 14, the rear support assembly 16, the front support assembly 18 and the motor mount assembly 20 are individually carted to the work site. The work site generally is a building basement and the task is to drill a small diameter bore hole through a basement wall to a street side utility trunk.

The rear and front support assemblies 16, 18 are connected to the opposite ends of the support rods 28. This is accomplished by inserting the respective ends of the support rods into the rear and front stops 38, 46 respectively and fixing them in place using bolts 84 as shown in FIG. 1. The head mounting plate 20 and the attached drill motor then is lifted by the handles 74 and placed on the barrels 30 of the hydraulic thrust cylinders by laying the yokes 72 between flanges 34. The mounting plate then is fixed to the barrels by inserting the lock pin 86 through openings in the flanges 34 that align with opening 67 (shown in FIG. 4) in the head brackets 66, 68.

One or more drill pipes 24 are attached to the spindle of the drive motor. The insertion of a vise 54 between the wrench stops 52 can aid in the attachment of the drill pipes. In this respect the vise is generally U-shaped wherein the legs of the U-shape bracket the drill pipe and engage the flats 88 at the end of a drill pipe. This fixes the pipe against rotation. With one of the drill pipes fixed against rotation by the vise 54, a manual wrench or a power wrench such as shown at 90 in FIG. 1 is used to attach or detach one drill pipe to another and the vise is removed.

The drilling apparatus 10 then is properly aligned and anchored in position. In this respect hydraulic jacks 82 are inserted in to the appropriate ports 80 and operated to brace the drilling apparatus against one or more of the walls ceiling or floor of the work site. The attitude of the drilling apparatus to properly align the drill pipe also is controlled by adjustment of the hydraulic jacks. For example one of the front and rear support assemblies 16, 18 can be raised or lowered relative to the other by the jacks to change the angle of attack of the drill bit on the end of the drill pipes. In a similar fashion the side-to-side angle of attack also can be adjusted by using the jacks to move one of the front and rear supports left or right of the other. It should be appreciated that when the drill apparatus is anchored in position, the parallel thrust cylinders 12, 14 together with the rear and front support assemblies 16,18 form a rigid frame and the cylinder barrels 30 are movable along this frame.

After the drilling apparatus is anchored in proper position, the drill motor is started to begin the drilling operation. As drilling progresses, fluid under pressure is controllably introduced into an inlet 32. This drives the barrel 30 in a forward direction and along the "frame" defined in part by the support rods 28. The thrust of the barrel is transmitted through the flanges 34 to the head mounting plate 20 to press the drill bit into the working face.

When the barrel has moved to the limit of its forward travel, the drill rod is separated from the drill motor by inserting the vise 54 and then using a manual wrench or the power wrench 90 to uncouple the drill rod from the motor. Fluid under pressure then is introduced into the other inlet 32 to move the barrel in an aft direction along the support rods. With the barrel at the aft limit of travel, an additional section of drill pipe is inserted to lengthen the depth of the bore. The separation of the drill pipe from the motor allows the operator to insert and attach an additional section of drill pipe after which the process is repeated to advance the head mounting plate 20 and drill motor towards the working face.

After the borehole is drilled, procedures are reverses to withdraw and separate drill pipes one from another. The hydraulic jacks are removed and the drilling apparatus is disassembled so the individual components can be transported to the next work site.

While the invention has been described in the context of drilling horizontal bore holes, it should be appreciated that the drilling apparatus can be used to drill vertical holes. It also can be used to drill from the street to the building basement or beneath buildings. Also, conventional drill pipes are hollow so that a drilling fluid can be introduced into the borehole. To facilitate such introduction, a rotating union can be attached to the motor 20 as shown at 92 in FIG. 1. While a hydraulic motor 20 is preferred, other types of motors can be used so long as they provide the torque needed to operate the drill bit.

Accordingly, it should be appreciated that the present invention accomplishes its intended objects in providing an improved drilling apparatus for drilling relatively small diameter underground bore holes. The apparatus comprises separate components that are portable and are easily assembled and disassembled The improvement in the drilling apparatus also derives in part in the elimination of the need for a separate frame that is anchored in position. Having the frame formed in part by components of the hydraulic thrust cylinders does this. In addition, components of the thrust cylinders also provide the guides for the drill motor thereby eliminating the need for a guide track separate and apart from the frame.

Having described the invention in detail, what is claimed as new is:

1. A portable drilling apparatus for drilling a bore hole into a workface, the apparatus comprising:

(a) a pair of hydraulic cylinders each including a barrel and a support rod extending axially through the barrel, the barrel being movable along the support rod, the hydraulic cylinders being horizontally disposed and arranged generally parallel one to another;

(b) a head mounting plate assembly attached to the barrels of the pair of hydraulic cylinders; and (c) a drill motor supported by the head mounting plate assembly, the drill motor driving a drill bit extending forward of the pair of hydraulic cylinders for drilling into the workface.

2. Apparatus as in claim 1 wherein the hydraulic cylinders each include a barrel and a support rod extending axially through the barrel, the barrel being movable along the support rod and having a flange attachable to the head mounting plate assembly.

3. Apparatus as in claim 2 wherein each barrel has a pair of the flanges that are spaced apart and the head mounting plate assembly is disposable between the flanges.

4. Apparatus as in claim 2 comprising front and rear support assemblies are releasably connectable to the ends of the support rods and maintain the support rods parallel one to another.

5. A portable drilling apparatus for drilling a bore hole into a workface, the apparatus comprising:

a pair of hydraulic cylinders horizontally disposed and arranged generally parallel one to another, the hydraulic cylinders each including a barrel and a support rod extending axially through the barrel, the barrel being movable along the support rod and having a flange;

a head mounting plate assembly supported by the pair of hydraulic cylinders the head mounting plate assembly comprising:

(a) a head bracket;

(b) a yoke fixed to each end of the head bracket, the yoke being sized to straddle the barrel; and (c) means to lock the head bracket to the flange on the barrel;

and a drill motor supported by the head mounting plate assembly, the drill motor driving a drill bit extending forward of the pair of hydraulic cylinders for drilling into the workface.

6. Apparatus as in claim 5 wherein the head mounting plate assembly comprises a pair of head brackets each attached at opposite ends to one of the yokes, the drill motor being mounted to one of the head brackets and each head bracket having a central opening to permit passage of a spindle of the drill motor.

7. Apparatus as in claim 6 including a handle extending between the head brackets.

8. Apparatus as in claim 6 wherein the head brackets each have aligned openings adjacent the yokes, the aligned openings coinciding with aligned openings in the flanges so as to receive a locking pin therethrough for locking the head mounting plate assembly to the barrels.

9. A portable drilling apparatus for drilling a bore hole into a workface, the apparatus comprising:

a pair of hydraulic cylinders horizontally disposed and arranged generally parallel one to another, wherein the hydraulic cylinders each include a barrel and a support rod extending axially through the barrel, the barrel being movable along the support rod;

front and rear support assemblies releasably connectable to the ends of the support rods and maintain the support rods parallel one to another;

wherein the rear support assembly comprises:

(a) a rear plate;

(b) a rear receptacle at each end of the rear plate, each rear receptacle having a forward facing opening to receive an aft end of the support rod; and (c) rear anchor tubes at each end of the rear plate, the rear anchor tubes releaseably receiving means for fixing the rear plate and therefore the rear support assembly in position relative to the workface;

a head mounting plate assembly supported by the pair of hydraulic cylinders; and a drill motor supported by the head mounting plate assembly, the drill motor driving a drill bit extending forward of the pair of hydraulic cylinders for drilling into the workface.

10. A portable drilling apparatus for drilling a bore hole into a workface, the apparatus comprising:

a pair of hydraulic cylinders horizontally disposed and arranged generally parallel one to another, wherein the hydraulic cylinders each include a barrel and a support rod extending axially through the barrel, the barrel being movable along the support rod;

front and rear support assemblies releasably connectable to the ends of the support rods and maintain the support rods parallel one to another, wherein the front support assembly comprises:

(a) a front plate having a through opening to permit passage of a drill pipe through the front plate;

(b) a rear receptacle at each end of the front plate, each front receptacle having a rearward facing opening to receive a forward end of the support rod; and (c) front anchor tubes at each end of the front plates, the front anchor tubes releaseably receiving means for fixing the front plate and therefore the front support assembly in position relative to the workface;

a head mounting plate assembly supported by the pair of hydraulic cylinders; and a drill motor supported by the head mounting plate assembly, the drill motor driving a drill bit extending forward of the pair of hydraulic cylinders for drilling into the workface.

11. A portable drilling apparatus for drilling a bore hole into a workface, the apparatus comprising:

a pair of hydraulic cylinders horizontally disposed and arranged generally parallel one to another, wherein the hydraulic cylinders each include a barrel and a support rod extending axially through the barrel, the barrel being movable along the support rod;

front and rear support assemblies releasably connectable to the ends of the support rods and maintain the support rods parallel one to another, wherein the front support assembly comprises:

(a) two front plates each with a through opening to permit passage of a drill pipe through the two front plates, the plates being generally parallel and defining a space therebetween;

(b) a pair of wrench stops in the space between the two front plates, one wrench stop being to either side of the through openings in the front plates, the wrench stops defining guide surfaces; and (c) a vise releasably inserted into the space and between the guide surfaces, the vise being U-shaped to bracket and engage against flats on the drill pipe a head mounting plate assembly supported by the pair of hydraulic cylinders; and a drill motor supported by the head mounting plate assembly, the drill motor driving a drill bit extending forward of the pair of hydraulic cylinders for drilling into the workface.

12. A portable drilling apparatus for drilling a borehole into a work face, the apparatus comprising:

(a) a pair of hydraulic cylinders arranged generally parallel one to another, each cylinder having a barrel and a support rod extending axially through the barrel, the barrel being movable forward and aft along the support rod in responses to the introduction of fluid under pressure into one end or another of the barrel;

(b) a head mounting plate assembly releaseably attached to the barrels of both cylinders;

(c) a drill motor supported by the head mounting plate assembly, the drill motor driving a drill bit extending forward of the pair of hydraulic cylinders towards the work face; and (d) forward and rear assemblies releaseably connecting forward and aft ends of the support rods one to another.

13. Apparatus as in claim 12 wherein at least one of the forward and rear assemblies include anchor tubes releaseably receiving an adjustable jack that is operable to fix the forward and rear assemblies in position relative to workface.

14. A portable drilling apparatus for drilling a borehole into a work face, the apparatus comprising:

a pair of hydraulic cylinders arranged generally parallel one to another, each cylinder having a barrel and a support rod extending axially through the barrel, the barrel being movable forward and aft along the support rod in responses to the introduction of fluid under pressure into one end or another of the barrel a pair of spaced flanges on each barrel;

a head mounting plate assembly releaseably attached to the barrels of both cylinders the mounting plate assembly including yokes receivable between the flanges a drill motor supported by the head mounting plate assembly, the drill motor driving a drill bit extending forward of the pair of hydraulic cylinders towards the work face; and forward and rear assemblies releaseably connecting forward and aft ends of the support rods one to another.

15. Apparatus as in claim 14 wherein the mounting plate assembly has a head bracket extending between the yokes, the drill motor being attached to the head bracket.

16. Apparatus as in claim 15 wherein the head bracket has an opening to accommodate passage of a spindle of the drill motor and a further opening aligned with an opening in each of the spaced flanges to accommodate passage of a lock pin for attaching the mounting plate assembly to the barrels.

17. A portable drill for boring horizontal underground holes comprising:

(a) a pair of hydraulic cylinders each comprising a support rod and a barrel slidably disposed on the support rod, each of the barrels having a mounting flange;

(b) rear support connectable to an aft end of each support rod;

(c) a front support connectable to a forward end of each support rod, the rear and front supports together supporting the cylinders generally parallel one to another;

(d) a head mounting plate connectable at opposite ends to the barrels wherein the movement of each barrel relative to the support rod is transmitted to the head mounting plate; and (e) a drill motor carried by the head mounting plate and operatively connected to a drill bit extending to a location forward of the front support.

18. Apparatus as in claim 17 further comprising a pair of spaced flanges on each of the barrels and the head mounting plate being retained between the flanges.

19. Apparatus as in claim 18 wherein the head mounting plate and flanges have aligned openings to accommodate a locking pin for holding the head mounting plate to the barrels.

20. A method for assembling a drilling apparatus for drilling small diameter bore holes comprising:

(a) arranging a pair of thrust cylinders one parallel to the other, each cylinder having a barrel and a support rod extending axially through the barrel wherein introducing fluid pressure into one end or the other of the barrel moves the barrel forward and aft respectively along the support rod;

(b) connecting forward and aft ends of the support rods one to another; and (c) releasably attaching opposite ends of a head mounting plate assembly to each of the barrels, the head mounting plate assembly carrying a drill motor for driving a drill bit that extends forward of the pair of cylinders.

21. A method as in claim 20 comprising connecting the forward and aft ends of the support rods together with forward and rear support assemblies respectively that maintain the support rods spaced apart and parallel one to another and adjusting the attitude of the drilling apparatus with jacks attachable to at least one of the forward and rear support assemblies.

* * * * *